United States Patent [19]

Yamamoto

[11] Patent Number: 4,862,010

[45] Date of Patent: Aug. 29, 1989

[54] METHOD OF STARTING ENGINE AND APPARATUS THEREFOR

[75] Inventor: Kyohei Yamamoto, Hyogo, Japan

[73] Assignee: Mitsubishi Denki Kabushiki Kaisha, Tokyo, Japan

[21] Appl. No.: 203,361

[22] Filed: May 27, 1988

[30] Foreign Application Priority Data

May 28, 1987 [JP] Japan ..... 62-135739

[51] Int. Cl.[4] ..... F02N 11/08

[52] U.S. Cl. ..... 290/38 R; 290/38 C

[58] Field of Search ..... 290/28, 31, 36 R, 36 A, 290/38 R, 38 C, 38 E, DIG. 1, DIG. 3

[56] References Cited

U.S. PATENT DOCUMENTS 2,952,782 9/1060 Woyden ..... 290/38 C
2,975,296 3/1961 Dominguez-Rego ..... 290/DIG. 3
4,236,594 12/1980 Ramsperger ..... 290/DIG. 3
4,305,002 12/1981 Mortensen ..... 290/DIG. 1
4,345,554 8/1982 Hildreth et al. ..... 290/38 R X
4,490,620 12/1984 Hansen ..... 290/38 R

*Primary Examiner*—William M. Shoop, Jr.
*Assistant Examiner*—W. E. Duncanson, Jr.

[57] ABSTRACT

A power supply to various electric accesaries of a vehicle is stopped when an instruction of engine starting is given after a engine key switch is turned on. An excitation current of an electromagnetic switch of an engine starter increases gradually with time and after checking various conditions necessary to start the engine therafter, the supply of the excitation current is blocked until a completion of engine starting is decided when the checking shows some problem on engine start and a power supply to the various electric accessaries is allowed after a completion or blocking of the excitation current.

2 Claims, 4 Drawing Sheets

METHOD OF STARTING ENGINE AND APPARATUS THEREFOR

BACKGROUND OF THE INVENTION

The present invention relates to a method of staring an engine for automatically starting the engine under a control of a starting system of the engine including a starter protection device, performed by a vehicle mounted microcomputer, and an apparatus therefor.

FIG. 3 shows a construction of a conventional engine atarting system such as disclosed in Japanese Patent Publication No. 10187/1985 and FIG. 4 is a flow chart showing an operation of a microcomputer used therein.

In FIG. 3, a reference numeral 1 depicts a vehicle mounted battery and 2 an engine key switch having an OFF terminal 2*a* for cutting a power source off, an ACC terminal 2*b* for supplying power to various accesaries of the vehicle and an IG terminal 2*c* for supplying power to various functional devices of the vehicle such as an ignition system.

In FIG. 3, a car radio device 3 which is one of the accesaries is connected to the ACC terminal 2*b* of the key switch 2. The ignition circuit 4 is shown an a typical example of the functional devices and connected to the IG terminal 2*c* of the key switch 2.

A hand brake switch 5 produces an on or off signal according to an operation thereof, which is supplied to the microcomputer 9.

A neutral sensor 6 produces an on or off signal according to a position of a change lever, which is also supplied to the microcomputer 9. An engine revolution sensor 7 detects an engine revolution and provides an output signal indicative of the latter which is supplied to the microcomputer 9.

A coolant temperature sensor 8 for detecting temperature of coolant such as water regulates a control of the automatic engine starting, an output signal of which is also supplied to the microcomputer 9.

The microcomputer 9 performs various operations according to predetermined programs, and, when it receives a signal indicative of an activation of the IG terminal 2*c* of the key switch 2, it checks signals from the hand brake sensor 5 and the neutral sensor 6. When the checks indicate incomplete engine starting conditions thereof, the microcomputer 9 provides an incomplete alarm signal.

When the checks indicate complete engine starting conditions, the microcomputer 9 provides a power supply start signal so that a power supply to an engine starter for a unit time necessary to start the engine is repeated at a predetermined interval and, when a completion of engine start is decided by the signal from the engine revolution sensor 7, the microcomputer 9 provides a power supply termination signal. The microcomputer 9 regulates the repetition times of the power supply to the starter, the unit time and the interval on the basis of the signal from the coolant temperature sensor 8. When it is impossible to start the engine even if the repetition times becomes a predetermined value, the microcomputer 9 stops to supply power to the starter and provides an impossible alarm.

An R-S flip-flop 10 which serves as a holding means is set by the power supply start signal from the microcomputer 9 and holds the set state to maintain a hold signal until it is reset upon the power supply termination signal therefrom.

A starter circuit 11 includes a starter motor and serves to supply power to the latter for a time period in which the hold signal is kept produced by the flip-flop 10.

An alarm 12 provides a continuous alarm signal indicative of incomplete condition for engine starting according to the incomplete condition alarm signal from the microcomputer 9 which is stored in a memory provided in the alarm 12.

A start impossible alarm 13 includes a memory for storing the impossible signal from the microcomputer 9 and provides a continuous alarm thereby.

The microcomputer 9 performs various other controls for various systems such as fuel injection system, ignition timing system, etc., than these mentioned above. Practically, the microcomputer 9 performs the engine starting control by utilizing time periods which are not used by these system controls.

The engine starting control will be described in more detail with reference to FIG. 4. When the key switch 2 is turned from the OFF terminal 2*a* to the ACC terminal 2*b*, the car radio 3 is supplied power from the battery 1 through the ACC terminal 2*b* and therefore the radio 3 can be turned on by a switch thereof. At the same time, other accesaries are also supplied power. However, since the IG terminal 2*c* is still opened, there is no power supply to the various function devices of the vehicle.

Then, when the key switch 2 is turned from the ACC terminal 2*b* to the IG terminal 2*c*, the function devices such as the ignition circuit 4 are supplied with power through the IG terminal 2*c* while the power supply to the accesaries through the ACC terminal 2*b* is maintained. Therefore, the microcomputer 9 becomes operative.

Upon the turning of the key switch 2 from the ACC terminal 2*b* to the IG terminal 2*c*, the microcomputer 9 starts to operate to perform the automatic engine starting from a key switch on step 101 and to a selfchecking step 102, as shown in FIG. 4. In the step 102, abnomalities of basic operation of the microcomputer 9 and its memories are checked by itself according to a predetermined self checking program. When there is any abnomality, the operation is shifted to an incomplete alarm step 105 to produce an incomplete alarm signal from the incomplete alarm 12.

When the check in the step 102 indicates no abnomality of computer operation, the operation is shifted to a hand brake decision step 103. In the step 103, it is checked from the signal from the hand brake sensor 5 whether or not a hand brake is effective, and, if no, the operation is shifted to the incomplete alarm step 105 to produce the incomplete alarm signal from the alarm 12.

On the other hand, the check in the step 103 indicates that the hand brake is effective, the operation is shifted to a neutral decision step 104.

In the step 104, it is checked according to the signal from the neutral sensor 6 whether or not the position of change lever is neutral. If no, the operation is shifted to the step 105 to produce the alarm signal from the alarm 12.

If yes, that is, if the operational function of the microcomputer 9 is normal, the hand brake is effective and the change lever is in neutral position, indicating a complete engine starting condition, the operation is shifted to a coolant temperature step 106 in which a temperature signal TW is obtained according to the signal from the coolant temperature sensor 8, and then the operation is shifted to a function setting step 107.

In the step 107, by using the coolant temperature TW as a variable, a starter power supply time $T_1=f_1$ (TW), the interval time $T_2=f_2$ (TW) and the number of starter power supplies $K=f_3$ (TW) are set. In this case, the times $T_1$ and $T_2$ depend upon the coolant temperature, the longer the higher, and are set about 5 seconds and about 10 seconds, respectively.

The number K of power supplies is a stepwise function of TW and is an interger reverse proportional to TW. The number K is set in a range from 3 to 5.

The operation of this conventional device will be described for a case where the starting condition is incomplete under conditions that the starter power supply time $T_1$ is 5 seconds, the interval $T_2$ is 10 seconds and the number K of power supplies is 3. A $T_1$ timer of 5 seconds is started in a timer start step 108 and the operation is progressed through a $T_1$ timer up decision step 109 to a starter power supply on step 110 in which a power supply start signal is supplied to the R-S flip-flop 10 to set the latter the holding signal of which is used to start a power supply to the starter circuit 11 and a loop from an engine start decision step 111 to the $T_1$ timer up decision step 109 is repeated.

When the engine is not started with this operation within the starter power supply time of 5 seconds, an output of the step 109 is turned from NO to YES and the operation is shifted to a starter power supply off step 114. In the step 114, a power supply termination signal is supplied to the R - S flip-flop 10 to reset the latter to thereby remove the holding signal and stop the power supply to the starter circuit 11.

Then, the operation is shifted to a $T_2$ timer start step 115 to start the 10 seconds operation of the timer $T_2$ and a return loop is repeated in a $T_2$ timer up decision step 116.

After the $T_2$ time period of 10 seconds lapses, the decision made in the step 116 is turned from NO to YES and the operation is shifted to a subtraction step 117 in which a subtraction $K=K-1$ is performed to change the number from 3 to 2, and the operation is returned through a number decision step 118 to the $T_1$ timer start step 108.

When the engine can not be started even when the same operation is repeated three times, the decision made in the step 118 is turned from NO to YES and the operation is shifted to an impossible alarm step 119 to provide an impossible alarm from the impossible alarm 13 in addition to the incomplete alarm from the incomplete alarm 12.

As to a case where the engine is started by a first power supply to the starter, the operation is performed from the steps 101 to 113 similarly, without the routine from the steps 114 to 119.

In the conventional system mentioned as above, the device is actuated by turning the engine key switch from the OFF terminal to the IG terminal. Therefore, there may be a case where a power supply to the starter motor is reduced due to an increase of power consumption of various accesaries connected to the ACC terminal, causing the starting operation difficult. Further, since the operation of the key switch is somewhat different from a conventional engine starting, there may be some troubles for untrained drivers.

Further, the power supply to the starter circuit is started after all of the checks for engine starting show complete conditions and continues until the decision of complete engine start or the provision of the start impossible alarm, it is impossible to terminate the power supply when a malfunction occurs after the checks.

In addition, since the holding means, flip-flop, provides instructions to start and to stop the power supply to the starter, it is impossible to control an excitation current of the starter motor by effectively utilizing the microcomputer, so that th conventional device is not suitable to obtain a starter device having a starter control. There have been various protective devices for protecting, for example, a starter against the problems mentioned above. However, these protective devices require control circuits specialized therefor, making them unsuitable to perform a control covering all of the starting system including automatic engine starting and protection of the starter by means of a microcomputer.

SUMMARY OF THE INVENTION

An object of the present invention is to provide a method of automatically starting an engine and an apparatus for performing the same, which is effective and safe in operation and capable of preventing an engine starting performance from being degraded and a vehicle from dashing abruptly, due to that fact that a total control of a starting system can be performed by using a vehicle mounted microcomputer without using any specialized control circuits.

The method of automatic engine starting according to the present invention comprises the steps of stopping a power supply to various electric accesaries of a vehicle when an instruction of engine starting is given after a engine key switch is turned on, starting a power supply such that an excitation current of an electromagnetic switch of an engine starter increases gradually with time, checking various conditions after the starting step, blocking the supply of the excitation current until a completion of engine starting is decided when the checking step shows some problem on engine start and allowing a power supply to the various electric accesaries after a completion or blocking of the excitation current.

The apparatus for performing the above method, according to the present invention comprises a drive means for supplying excitation current to the electromagnetic switch of the starter, a relay means for on-off controlling power supplies to the accessaries, the relay means being actuated when an engine start instruction is received after turning on of a key switch to stop the power supplies to the accessaries, the drive means being actuated such that the excitation current increases with time gradually, and a control means for stopping an operation of the drive means until a completion of engine start is decided, when there is any trouble in starting engine, and allowing the relay means to supply power to the accessaries after a completion or stoppage of operation of the drive means.

In the present invention, upon the engine start instruction after the key switch is turned on, the power supply to the various accessaries is stopped and the excitation current to the electromagnetic switch of the starter is increased gradually with time. Various conditions necessary to start an engine are checked before the electromagnetic is turned on and, when all of the conditions are preferrable, the current supply to the electromagnetic switch is allowed to continue to thereby actuate the starter. The supply of the excitation current is terminated after the engine started. When there is any problem in the conditions, the supply of the excitation current to the electromagnetic switch is stopped until a completion of engine start is decided after the checks are performed.

In the apparatus for performing the method, upon the receiption of the engine start instruction after the turning on of the key switch, the control means actuates the relay means to stop power supply to the accessaries and actuates the drive means to increase the excitation current to the electromagnetic switch with time. Further, the control means serves to stop the operation of the drive means until the completion of engine start is decided when some problem occurs in starting the engine and allow the relay means to supply power to the accessaries after the operation of the drive means completes or is stopped.

DETAILED DESCRIPTION OF THE PREFERRED EMBODIMENT

Figure 1:
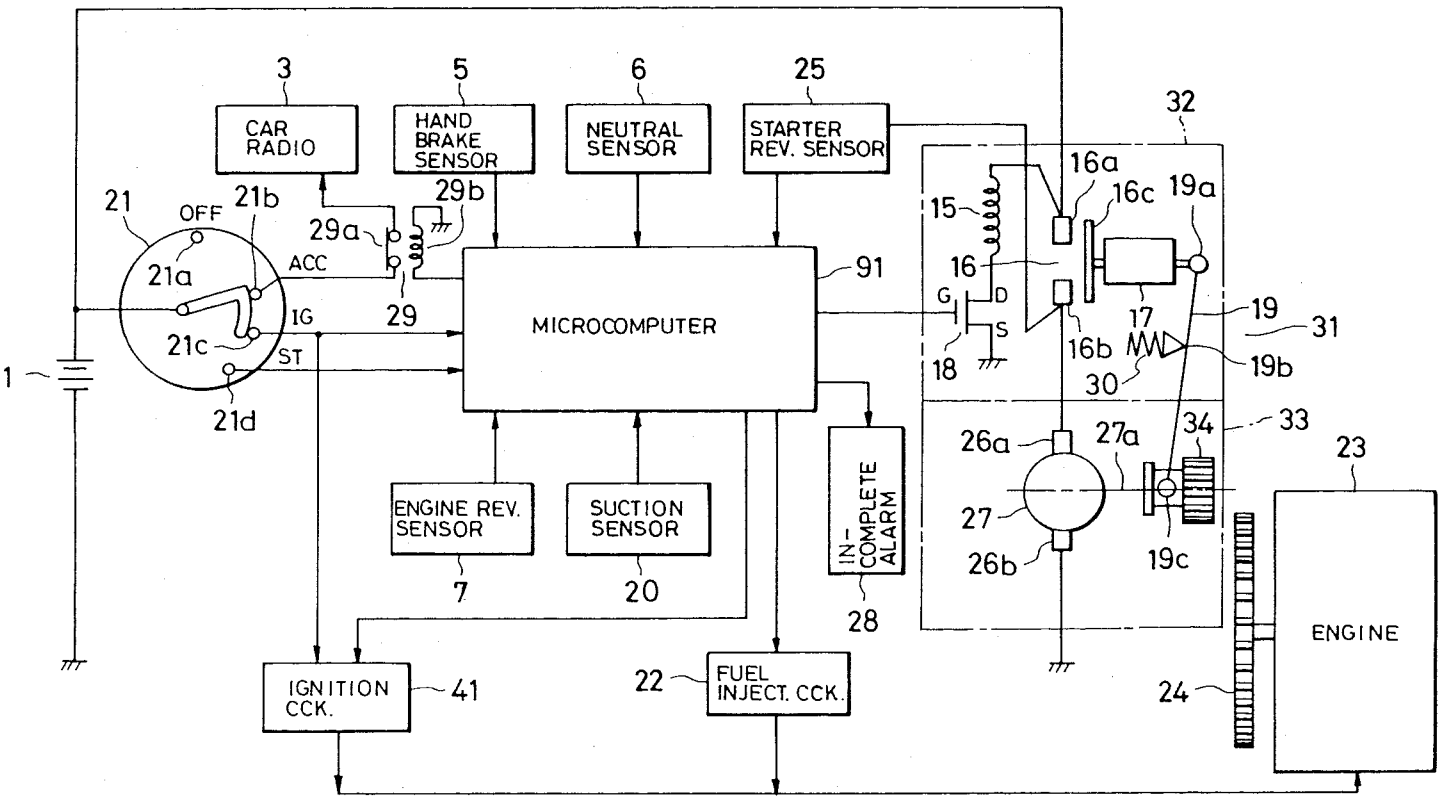
FIG. 1 is a block circuit diagram showing an embodiment of an apparatus for performing a method of the present invention.
Figure 3:
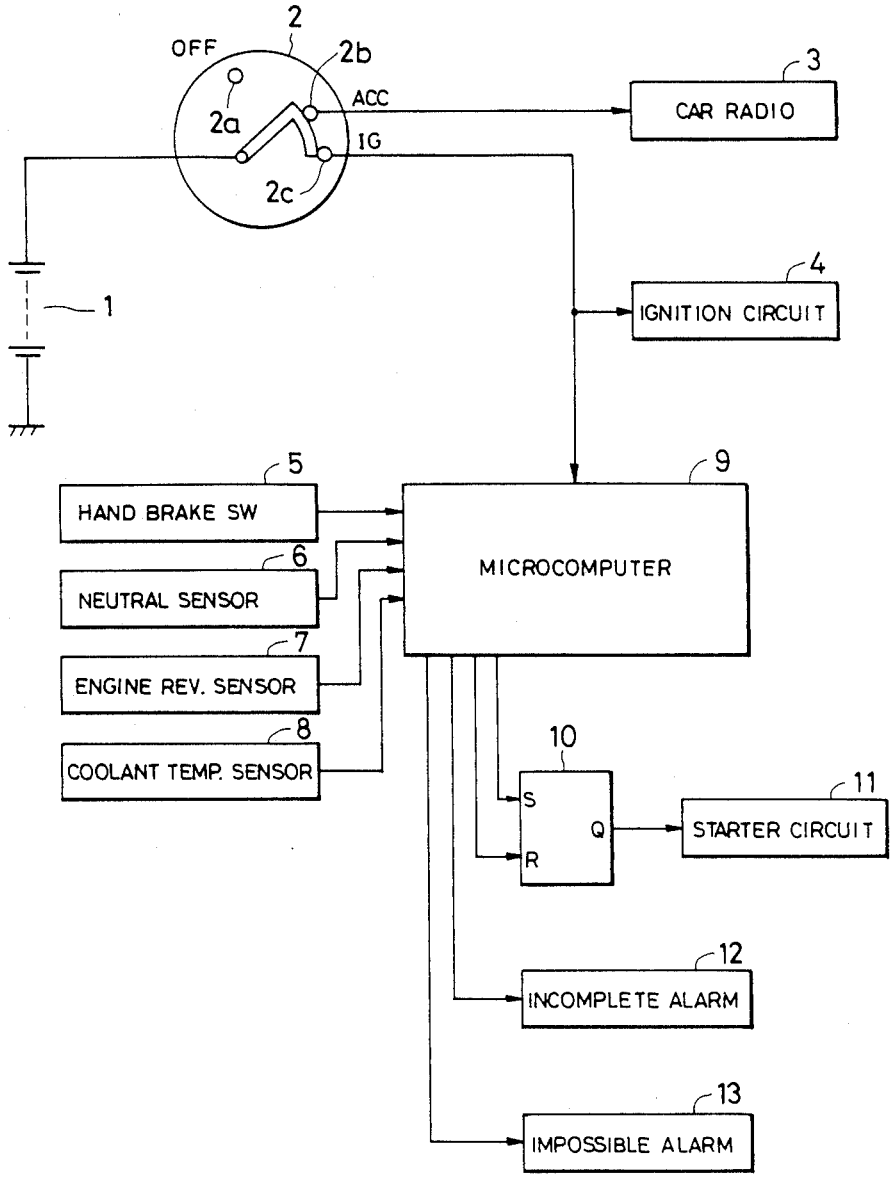
FIG. 3 is a block circuit diagram of a conventional automatic engine starting device.
Figure 4:
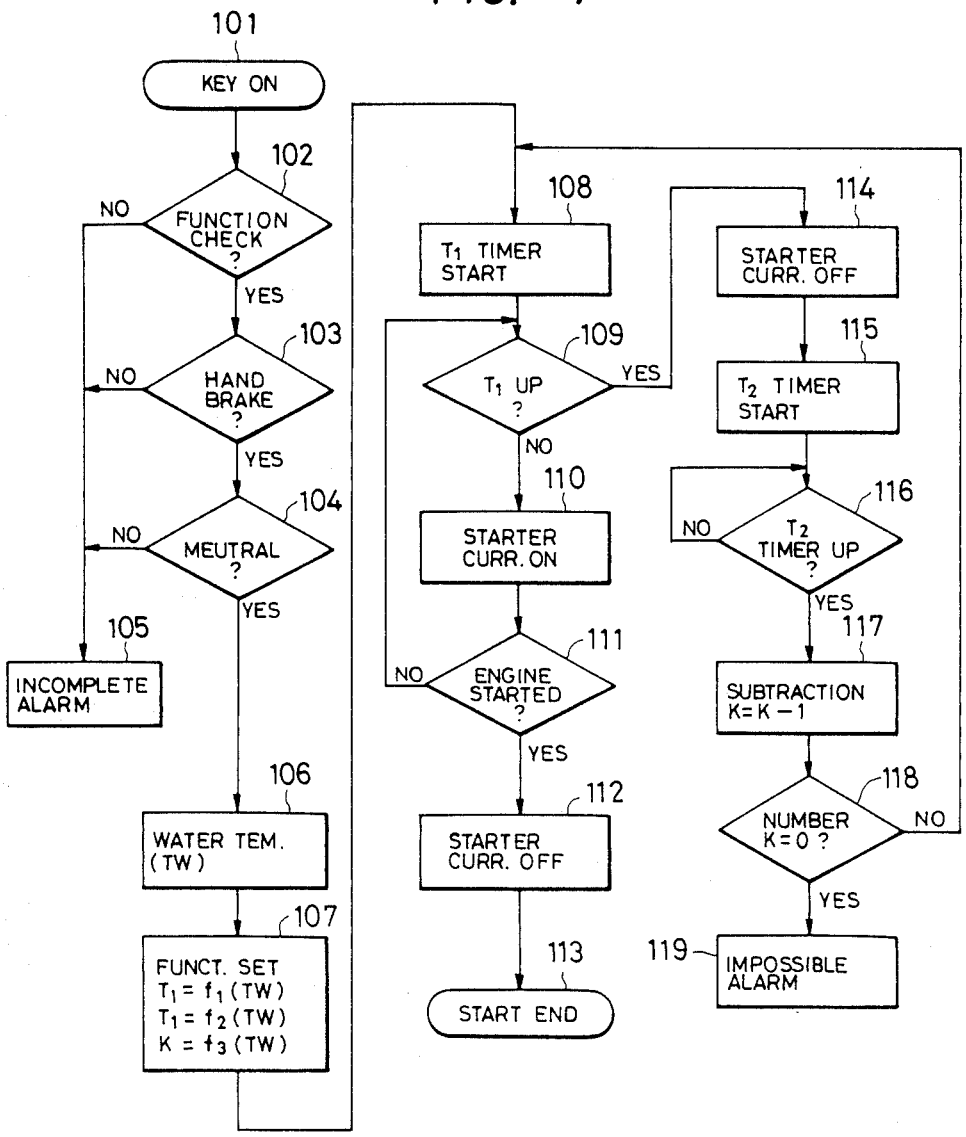
FIG. 4 is a flow-chart showing an operation of the device shown in FIG. 3.

In FIG. 1 which is a block diagram showing an embodiment of the present invention and includes various components which are similar to those shown in FIG. 3 and depicted by same reference numerals, respectively, a reference numeral 1 depicts a battery and 21 a key switch which is usual in construction. The key switch 21 includes an OFF terminal 21*a* for cutting a connection to a power source, an ACC terminal 21*b* for supplying power to various accessaries including car radio 3, an IG terminal 21*c* for supplying power to various functional devices including an ignition system and a microcomputer 91 and an ST terminal 21*d* for supplying an engine start instruction to the microcomputer 91.

As usual, the key switch 21 is switched from an OFF position through an ACC and an IG position to an ST position by inserting a key thereinto and turning it. At the IG position, the ACC terminal 21*b* is also connected together and this condition is kept during a normal operation of the engine after ignited.

At the ST position, the IG terminal 21*c* and the ST terminal 21*d* are connected together. Once the ST terminal 21*d* is connected, the microcomputer 91 starts its operation upon an instruction of engine start.

The key at the ST position is retuned by a return spring to the IG position automatically by allowing the key to rotate freely.

The ACC terminal 21*b* of the ke switch 21 is connected through a normally closed contact 29*a* of a relay 29 to the car radio 3. The normally closed contact 29*a* is selectively turned on by an operating coil 29*b* which is controlled by the microcomputer 91.

The IG terminal 21*c* is connected to the microcomputer 91 and an ignition circuit 41 which is one of the functional devices of the vehicle.

A hand brake sensor 5 for producing an on or off signal depending upon a condition of hand brake operation, a neutral sensor 6 for producing an on or off signal depending on whether or not a change lever is positioned in a neutral and an engine revolution sensor 7 for producing a signal corresponding to the engine revolution are connected to the microcomputer 91.

A starter revolution sensor 25 detects a revolution of a starter motor on the basis of a voltage generated thereby during its revolution of inertia and has an input connected to a fixed contact 16*b* of a main contact 16 of an electromagnetic switch 31 and an output connected to the microcomputer 91.

The hand brake sensor 5, the neutral sensor 6, the engine revolution sensor 7 and the starter revolution sensor 25 constitute detection means for detecting conditions under which a starting of engine is possible.

The engine revolution sensor 7 serves also an operation sensor for detecting an engine operation.

The microcomputer 91 is powerd through the IG terminal 21*c* and receives a start instruction from the ST terminal 21*d* to control a gate G of a semiconductor switching element 18 which is, in this embodiment, a power MOSFET and constitutes a drive means for the excitation coil 15 of the electromagnetic switch such that an excitation current increases with time. The microcomputer 91 checks the various conditions during a period up to a time at which the normally opened main contact 16 is closed and, when these conditions are satisfied, allow the increase of excitation current to continue.

The microcomputer 91 reads a suction pressure (in this case, atomospheric pressure) from a suction pressure sensor 20 and controls the ignition circuit 41 and a fuel injection circuit 22, etc., after the main contact 16 is closed while driving the semiconductor switching element 18, and, when a completion of engine start is decided from the output signal of the engine revolution sensor 7, terminates the driving operation of the semiconductor switching element 18.

When there is any problem checked by the aforementioned checks, the microcomputer 91 stops to drive the semiconductor switching element 18 until an end of a time including the checking time, at which an engine starting is completed lapses and actuates an incomplete alarm 28. Further, the microcomputer 91 makes the contact 29*a* closed after the power supply to the operating coil 29*b* is terminated by the completion or stoppage of the excitation current suply, as shown in FIG. 3 to restart the power supply to the accessaries.

The engine starter 31 is composed of the electromagnetic switch 32 and a starter motor 33. Since the excitation current is controlled by the semiconductor switching element, there is no need of provision of a relay which is necessay in the past.

The normally open main contact 16 of the electromagnetic switch 32 is constituted with a pair of fixed contacts 16*a* and 16*b*. The fixed contact 16*a* is connected to a positive terminal of the battery 1 and the fixed contact 16*b* is connected to the starter motor 33.

An exciting coil 15 is powered through the semiconductor switching element 18 to attract a plunger 17 of the electromagnetic switch 32 in a leftward direction on the drawing sheet.

An armature 27 of the starter motor 33 is fed through brushes 26*a* and 26*b* to produce a rotational force. On a shaft 27*a* of the armature 27, a pinion 34 is mounted axially slidably to transmit the rotational force to a ring gear 24 of the engine 23.

An upper portion 19*a* of a lever 19 rotatably supported at a point 19*b* engages with the plunger 17 and a lower portion 19*c* thereof engages with the pinion 34 which is moved towards the ring gear 24 to mesh therewith when the plunger 17 is attracted.

When the pinion 34 is moved towards the ring gear 24 by the plunger 17 attracted and failed to mesh with the ring gear 24 while end faces thereof are mated, a lever spring 30 is compresed in a leftward direction to provide a rightward load to the pinion 34 and allow the plunger 17 to move leftwardly to thereby the main contact 16 to be closed.

Figure 2:
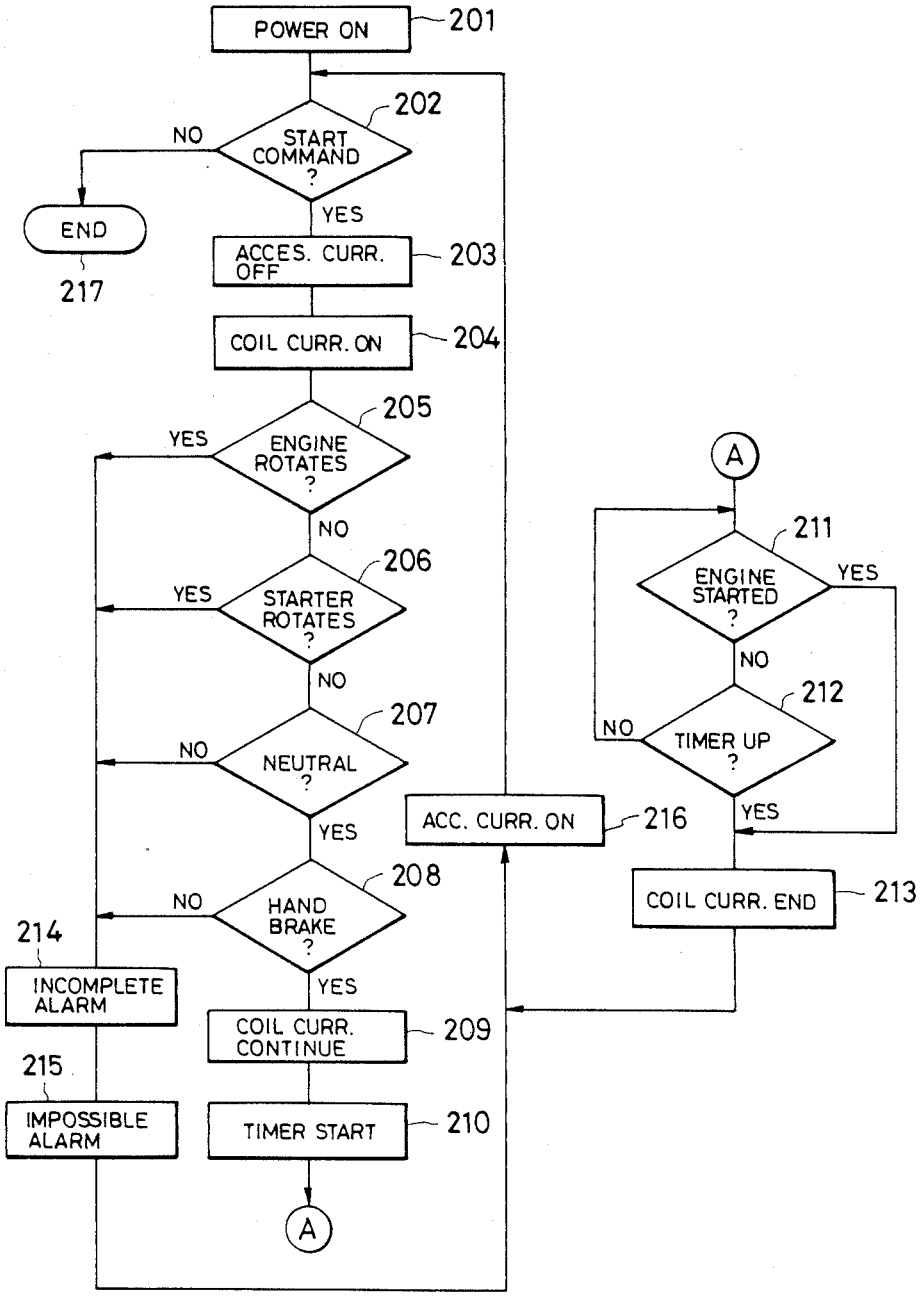
FIG. 2 is a flow-chart showing an operation of a microcomputer used in the embodiment shown in FIG. 1.

An operation of the present device mentioned above will be described with reference to a flowchart shown in FIG. 2.

When the key switch 21 is turned from the OFF terminal 21*a* to the ACC terminal 21*b*, a power is supplied from the battery 1 through the ACC terminal 21*b* and the normally closed contact 2 to the car radio 3 which is actuated by turning its main switch on.

At the same time, power is supplied to other accessaries not shown. Since in this case the IG terminal 21*c* is still opened, there is no power supply to the various functional devices of the vehicle.

Then, when the key switch 21 is turned to the IG terminal 21*c*, power is supplied to the functional devices including the ignition circuit 41 through the IG terminal 21*c* while the power supply to the accessaries continues, and the microcomputer 91 is also powered thereby.

Then, when the key switch 21 is turned to the ST terminal 21*d*, the power supply from the battery 1 to the ACC terminal 21*b* is terminated and the supply therefrom to the IG terminal 21*c* and the ST terminal 21*d* is started. The microcomputer 91 receives an engine start instruction from the ST terminal 21*d* and performs an operation shown by the flow-chart in FIG. 2. A power on step 201 corresponds a state where the key switch 21 takes in the IG terminal position by which the power source is connected in circuit.

Then, when the switch is turned to the ST terminal 21*d*, the microcomputer 91 is adapted to receive the start instruction in a start instruction step 202. If it does not receive the instruction, i.e., when the key switch is not turned up to the ST terminal 21*d*, the operation is shifted to a step 217 in which the operation is terminated. If it rceceives, the operation is shifted t a step 203 in which the microcomputer 91 supplies a power to the operating coil 29*b* of the relay 29 to open the normally closed contact 29*a* to thereby stop a power supply to the various accessaries such as car radio 3.

Then, the operation is shifted to a step 204 in which the microcomputer 91 starts to drive the semiconductor switching element 18 to control a duty of excitation current such that the excitation current increases gradually with time.

Thereafter, in an engine revolution step 205, the output signal of the engine revolution sensor 7 is checked as to whether or not the engine 23 is rotating. If no, the operation is shifted to a starter rotation step 206.

In the step 206, the output signal of the starter rotation sensor 25 is checked as to whether or not the armature 27 of the starter 31 is rotating. If no, the operation is shifted to a neutral step 207.

In the step 207, the output signal of the neutral sensor 6 is checked as to whether or not the position of the change lever is neutral. If yes, the operation is shifted to a hand brake step 208.

In the step 208, the output signal of the hand brake sensor 5 is checked as to whether or not the hand brake is effective. If yes, the operation is shifted to a coil current keeping step 209.

In the step 209, the exciting current supply is continued, since the various checks made in the steps 205 to 208 after the commencement of gradual increase of the exciting curent in the step 204 indicated favorable results, and the timer is started in a timer start step 210. Then, the main contact 16 is closed.

Since, in this embodiment, the exciting current increases with time, the attracting force affecting the plunger 17 increases gradually, so that the plunger 17 moves smoothly. This eliminates a collision of the pinion 34 to the ring gear 24 due to an abrupt movement of the plunger 17 which is unavoidable when the exciting current is supplied directly through a starter switch or a relay to the exciting coil. Further, it is possible to eliminate the problem that, due to such abrupt movement of the plunger 17, the lever spring 30 is compressed, so that the main contact 16 is closed before the pinion 34 reaches the ring gear 24 and the pinion 34 collides with the ring gear 24 while being rotated by the armature 27, causing an erroneous meshing. Thus, the life of the pinion 34 and/or the ring gear 24 is improved.

Since the output signal of the suction pressure sensor 20 is read during a time from the commencement of the exciting current supply to the closure of the main contact 16, the reading of the suction pressure, in this case, atomospheric pressure, can be done exactly before a voltage drop of the battery occurs due to a transient current caused by the closure of the main contact 16, resulting in an improvement of preciseness of fuel injection control, etc.

In the step 211, the output signal of the engine revolution sensor 7 is checked as to whether or not the starting of the engine completes. This judgement should be made exactly in such a way that the engine starting is judged when the revolution becomes a certain value, for example, 1000 rpm, and this value is maintained for a certain time, for example, 1 second.

When the judgement made in the step 211 is affirmative, the operation is shifted to a current supply termination step 213 in which, in order to terminate the driving of the semiconductor switching element 18 to thereby terminate the current supply to the exciting coil 15, the microcomputer 91 causes the movable contact 16*c* and the plunger 17 to returned by a return spring (not shown) to the shown positions to close the main contact 16 to thereby retur the pinion 34 from the ring gear 24 as shown so that the armature 27 can be stopped after an inertial revolution for several seconds.

When the judgement made in the step 211 is negative, the operation is shifted to a time up step 212 in which it is checked whether or not a set time lapses after the timer started in the step 210. If yes, the current supply to the exciting coil 15 is stopped in the step 213. If no, the operation is returned to the step 211.

The steps 211 and 212 are repeated and when the decision made in the step 211 becomes affirmative, the operation is shifted to the step 213. When the decision made in the step 212 becomes affirmative, the operation is forcibly shifted to the step 213 even if the judgement of the engine start completion is not obtained. In this case, the set time may be about 5 seconds.

When the decisions made in the respective steps 205 and 206 are yes while the decisions made in the steps 207 and 208 are no, the microcomputer 91 provides, in the step 214, a incomplete alarm signal upon which the incomplete alarm 28 is activated.

Thereafter, the microcomputer 91 stops the current supply to the exciting coil 15 in the step 215 without closing of the main contact 16.

The step 205 is to prevent an actuation of the starter from occuring when an engine start operation is made erroneously during the engine is rotating.

The step 206 is to prevet an actuation of the engine starter during the armature 27 is rotating by inertia.

The step 211 is to prevent an overrun of the starter motor 33 at high speed for a considerable time from occuring through the ring gear 24 and the pinion 34 after the judgement of the start completion is obtained.

The step 212 is to prevent the starter 31 from being burnt by a long time actuation thereof the battery 1 from being over discharged when the engine starting is difficult. This is also effective to prevent the pinion 34 and the ring gear 24 from being damaged and to protect the various mechanical elements of the starter against shocks and overloads. Thus, the protection device for the starter 33 can be provided on the program of the microcomputer 91, in addition to the automatic engine starting function thereof.

When the output signals of the engine revolution sensor 7 and/or the starter rotation sensor 25 can not be supplied to the microcomputer 91 for some reasons such as breakage of wirings etc., the decisions to be made in the steps 205 and/or 206 becomes negative. Even in such case, after the engine is started by executions of the subsequent steps, it is possible to stop the current supply to the exciting coil 15 by means of the step 212 after the set time lapses and to stop the starter.

The microcomputer 91 continues to check the output signals of the neutral sensor 6 and the hand brake sensor 5 ven after the operation is shifted to the step 209 upon affirmative decisions made in the steps 207 and 208 and, when a gear chane operation or a hand brake releaf operation is made during a time up to the start completion decision in the step 211, provides an incomplete alarm signal after which it executes the steps 214 and 215.

After the execution of the step 213 or 215, the current supply to the operating coil **29*b* is terminated in an accessary current on step 216 to return the contact 29*a* to the closed state as shown to thereby allow the current supply to the accessaries including the car radio 3 and the operation is returned to the step 202**.

In this case, when there is no conection to the ST terminal **21*d*, i.e., there is no engine start instruction, the decision made in the step 202 is negative and the engine start control is terminated in a termination step 217**.

When a start instruction is given again due to a failure of preceding start instruction or an erroneous start instruction is given after the engine start is completed, the decision made in the step 202 becomes affirmative and the subsequent steps are executed.

In the case of erroneous start instruction, the decision of the step 205 becomes affirmative and the actuation of the starter is prevented as mentioned before.

In the conventional device, the microcomputer 91 is supplied with some of signals from the sensors used in this invention, such as engine revolution signal and suction pressue signal etc., already. Therefore, the present invention can be realized by adding some sensors to the conventional system and slightly changing the program.

Although, in the mentioned embodiment, the engine start instruction is given through the ST terminal **21*d***, it is possible to give the instruction by means of a push botton after connecting the power source or by means of a predetermined code.

As described hereinbefore, according to the present invention, the power supply to the electrical accessaries is stopped when the engine start is performed and therefore the engine starting performance is not influenced thereby. Further, in the present invention, the various conditions necessary to start the engine are checked during the exciting current is increased gradually and when, the conditions are satisfied, the starter is actuated. After the engine is started, the current supply to the exciting coil is terminated. When some of the conditions are not satisfied before the engine starting completes, the current supply to the exciting coil is stopped. Therefore, it is possible to prevent an undesired start of the vehicle, resulting in a safe automatic engine staring.

Due to the gradual increase of the exciting current, the meshing of the pinion with the ring gear of the engine becomes smooth. The output signal of the engine revolution sensor is effectively used to prevent the overruning of the starter and to prevent an erroneous actuation thereof during the engine rotating and the output signal of the starter rotation sensor is effectively used to prevent the actuation during its inertial rotation. These can improve the duration of mechnical elements including the pinion and the ring gear of the device.

Further, the automatic engine starting and the protection of the starter can be given by a program of the vehicle mounted microcomputer compatibly and thus a total control of the engine starting system can be realized without using specialized control circuits.

What is claimed is:

1. A method of starting an engine automatically comprising the steps of stopping a current supply to electrical accessaries of a vehicle when an engine start instruction is given after a power source is connected by a key switch and starting an exciting current supply to an electromagnetic switch of an engine starter such that the exciting current supplied to said electromagnetic switch increases gradually, checking various conditions necessary to start the engine before said electromagnetic is closed, continuing the gradually increasing exciting current supply to said electromagnetic switch when said conditions are satisfied to close said electromagnetic switch to thereby supply a current to said starter so that the engine is started thereby and terminating said exciting current when a completion of engine start is confirmed, stopping said exciting current for a time including a time period for which said checking step is executed and ending at a time when said completion of engine start is not confirmed, and allowing a current supply to said accessaries after the termination or the stopping of said exciting current.

2. An automatic engine starting device comprising an engine starter having an electromagnetic switch and adapted to start an engine upon a closure of said electromagnetic switch, driving means for supplying an exciting current to said electromagnetic switch of said engine starter, a relay device for on-off controlling a current supply to various electric accessaries of a vehicle, detection means for detecting various conditions necessary to start said engine, an operating sensor for detecting an operating condition of said engine, and control means, said control means being adapted to actuate said relay device to stop a current supply to said accessaries when an engine start instruction is given after a power source is connected in circuit by a key switch and to actuate said driving means such that said exciting current increases with time, said control means being adapted to check output signals of said detecting means during a time from said actuation of said driving means up to a closure of said electromagnetic switch, to allow said increse of said exciting current to a value at which said electromagnetic switch is closed, to terminate an operation of said driving means when a completion of an engine start is confirmed by said operating signal of said operating sensor, to stop said operation of said driving means for a time including a time period for which said checking of said output signals of said detecting means are performed and ending at a time at which said completion of said engine start is not confirmed when any of said various conditions is not satisfied and to allow a current supply to said accessaries by said relay device after a termination or stoppage of operation of said driving means.

* * * * *